US006224474B1

(12) United States Patent
Vander Voort

(10) Patent No.: US 6,224,474 B1
(45) Date of Patent: May 1, 2001

(54) MAGNETIC DISC SYSTEM FOR GRINDING OR POLISHING SPECIMENS

(75) Inventor: George Frederic Vander Voort, Wadsworth, IL (US)

(73) Assignee: Buehler, Ltd., Lake Bluff, IL (US)

( * ) Notice: Subject to any disclaimer, the term of this patent is extended or adjusted under 35 U.S.C. 154(b) by 0 days.

(21) Appl. No.: 09/226,588

(22) Filed: Jan. 6, 1999

(51) Int. Cl.[7] ..... B24D 9/00
(52) U.S. Cl. ..... 451/494; 451/526; 451/538
(58) Field of Search ..... 451/494, 526, 451/538, 921, 288, 287

(56) References Cited

U.S. PATENT DOCUMENTS

| | | | | |
|---|---|---|---|---|
| 4,162,899 | | 7/1979 | Molner et al. . | |
| 4,222,204 | * | 9/1980 | Benner | 51/362 |
| 4,667,447 | * | 5/1987 | Barton | 51/362 |
| 4,807,404 | * | 2/1989 | Lewis | 51/362 |
| 4,882,878 | | 11/1989 | Benner . | |
| 4,938,379 | * | 7/1990 | Kellner | 220/570 |
| 5,226,536 | * | 7/1993 | Elliott | 206/369 |
| 5,628,679 | * | 5/1997 | Shiga | 451/508 |
| 5,937,453 | * | 8/1999 | Hodak et al. | 4/508 |
| 5,957,325 | * | 9/1999 | Montanez | 221/131 |

FOREIGN PATENT DOCUMENTS

| | | |
|---|---|---|
| 2226068 | 11/1974 | (FR) . |
| 1403167 | 8/1975 | (FR) . |
| 1441899 | 7/1976 | (FR) . |
| WO9607508 | 3/1996 | (WO) . |
| WO9830359 | 7/1998 | (WO) . |

OTHER PUBLICATIONS

TBW Industries, Inc., Brochure for GRID–ABRADE.
TBW Industries, Inc., Brochure for OMNI–BRADE™.
Mark V Lab Metallographic Supplies & Equipment catalog and price sheet with listing for MAGNA DISC SYSTEM (p. 19), published 1987.

* cited by examiner

*Primary Examiner*—Joseph J. Hail, III
*Assistant Examiner*—William Hong

(57) ABSTRACT

A magnetic disc system for grinding or polishing metallographic test specimens on a movable platen includes a barrier that is magnetically attached to a movable platen. A grinding or polishing surface attaches to the barrier. The barrier magnetically attaches to the platen and is also capable of blocking or greatly reducing the magnetic field magnetism from passing through to the grinding or polishing surface and restricting or preventing swarf adhesion resulting from the polishing or grinding operation that could harm the prepared surface.

31 Claims, 3 Drawing Sheets

MAGNETIC DISC SYSTEM FOR GRINDING OR POLISHING SPECIMENS

BACKGROUND OF THE INVENTION

This invention relates to grinding or polishing systems. More specifically, this invention relates to systems for grinding or polishing a specimen's surface on a rotatable or movable platen.

Metallographic studies are typically conducted by properly polishing and etching the surface of a specimen so that it may be examined with a microscope. The polishing operation usually involves positioning the surface of the specimen to be polished against a grinding or polishing paper or cloth mounted on a rotating, circular platen. Normally, an abrasive and wetting/cooling agent is applied to the cloth or paper to facilitate the grinding and polishing operation.

Historically, metallographers have attached grinding papers or polishing cloths to platens in several ways. One approach was to lay the grinding paper on a "wheel" (i.e., a round, rotating platen surface) wetted with water and then slip a tight fitting ring over the periphery of the paper. In some systems, this ring mated with a beveled, raised portion beyond the edge of the paper on the platen. In other systems, the paper extended to the edge of the flat platen, and the hold-down ring covered the outer edge of the paper and part of the outer edge of the periphery of the platen perpendicular to the platen surface. Use of water enhanced adherence of the grinding paper to the platen. The combination of the effect of water and the retention ring around the paper edge usually provided adequate "adhesion" so that the paper would rotate with the wheel when the metallographic specimen was pressed against it. Initially, there might be some slippage, but this would usually stop during use.

Another prior art method utilized a polishing cloth. When using a polishing cloth, the metallographer would provide a cloth of greater diameter than that of the platen by several inches. The cloth was placed over the platen surface, and a round band of steel having a diameter slightly larger than the platen's diameter, was placed over the cloth around the platen periphery. This band could be tightened by turning a screw which connected the ends of the band. The cloth edges extending down between the band and the platen were pulled to stretch the cloth tightly over the platen surface. Then the band was tightened by turning the screw. If stretching of the cloth was inadequate, the polishing rate would be reduced. Further, the cloth could be gouged or ripped, especially if unmounted specimens were being polished.

Another, more modern approach to fasten grinding paper, polishing cloths, and other preparation surfaces to the platen, was to use a pressure-sensitive adhesive (PSA) film on the back of the material—paper, cloth, etc. The PSA backing held the grinding or polishing material affixed to the platen. The strength of the adhesive affected the performance of the polishing material. If the adhesive was too weak, the PSA backed material may come off during use. If the adhesive was too strong, the material may be difficult to remove from the platen when it was to be replaced. Nonetheless, most metallographers prefer the PSA-backed grinding and polishing materials or products, rather than the non-PSA products since they are simple to use.

Some products, such as grinding paper, have a short life; whereas polishing cloths can last for many days depending upon the number of specimens polished. To reduce costs, many labs keep a polishing cloth on a platen until the cloth is completely worn. Further, a given polishing cloth is used with only one specific abrasive. Hence, most labs need a number of platens, each one being covered by a different polishing cloth or several having the same polishing cloth for use with different abrasives.

Because platens are expensive, rather than having a large inventory of platens covered with the various grinding and polishing materials, alternate approaches have been used. One alternative was to use the same platen in combination with numerous, easily removable sheet steel discs, each disc having a distinctive pressure sensitive adhesive cloth glued to one side. Any of the steel discs could then be attached to the platen using a hold-down ring around the disc-platen periphery to keep the disc in place while permitting easy and quick replacement. This approach has a disadvantage common to all such procedures. Namely, to achieve good flatness over the entire specimen's polished surface, particularly with large specimens, the specimen must periodically be moved to the extreme edge of the grinding paper or cloth surface (particularly the former). This approach is most easily done using automatic polishing devices but is nearly impossible to do with "hand" (manual) polishing. With certain grinding and polishing machines, it is impossible to move the specimen over the edge of the grinding or polishing surface without accidentally hitting the retention ring thereby damaging the specimen.

To reduce the need for multiple platens, others have used magnetic materials to attach the grinding or polishing disc to the platen. Thus, in one such alternative system, a rubberized magnetic disc is permanently attached to a platen using an extremely strong adhesive. The steel disc (with the polishing material thereon) can then be held on the platen by the magnetic field from the magnetic layer of material adhered on the platen. However, because the magnetic material will eventually wear, diminish or degrade or the magnetic field will become reduced in strength during use, this approach requires the user to eventually purchase a new platen with a magnetic material surface layer.

If grinding with silicon carbide (SiC) paper is to be performed, thin steel discs with the paper adhered thereto can be used to magnetically attach the SiC paper to the platen. Typically, after two minutes or less of grinding, SiC paper will be worn and must be removed to allow another sheet of SiC grinding paper to be attached to the disc. Thus even though the steel disc remains attached magnetically to the platen, a system using SiC paper for grinding or polishing requires constant replacement of the SiC paper.

Another magnetic attachment system uses a steel-backed disc with the surface of the disc partially covered by hexagon-shaped areas of a resin containing iron, copper or other metal particles used for grinding with added diamond abrasive. This plate is placed on and retained by the magnetic material disc attached to the platen. This disc is used after the first grinding step (for example, 120, 180, or 240 grit SiC paper depending on the material being prepared) to replace the subsequent SiC paper steps (320, 400, and 600 grit for example) and 9 or 15 $\mu$m diamond is sprayed onto the surface for grinding. After use of the hexagon-shaped resin coated steel disc, a variety of grinding and polishing cloths can be used on the specimen. The cloths are typically permanently glued onto a thin, flexible sheet of steel. The cloth covered steel disc is then held magnetically on the magnetic material-covered platen. When the cloth is worn, the cloth with its steel back is discarded. Discarding the steel plate having the attached worn cloth presents an undesirable situation from the standpoint of waste disposal. It is undesirable to discard steel in this manner because steel with a permanently attached cloth is difficult to properly recycle.

Another magnetic-disc system uses a series of wire-mesh discs with diamond abrasive firmly attached to the top surface of the wire mesh or screen. Three disc grades are available: fine grind (FG), rough polish (RP), and medium polish (MP). First, the specimens may need to be ground flat using SiC paper. Then a platen with a piece of PSA-backed magnetic, rubberized material is used in combination with a disc. Thus, a FG disc is magnetically attached to the magnetic rubberized material on the platen, and the sample is ground. This is repeated using the RP and MP discs each magnetically attached to the platen. A standard final cloth polishing step is usually required to complete the preparation.

All the described magnetic disc systems generate a magnetic field that surrounds the test sample during the grinding or polishing step. In addition, for specimens that are ferromagnetic materials, including iron, cobalt, nickel, gadolinium, and Huesler alloys, grinding and polishing produce fine particles, "swarf." This swarf may adhere to the preparation surface due to the magnetic field and degrade the surface quality of the specimens being prepared.

Thus, all of the previously described magnetic attachment systems are susceptible to magnetically attracted swarf when preparing ferromagnetic materials, that can degrade the prepared surface. In addition, the previously described magnetic attachment systems do not avoid the problems of PSA product which may detach prematurely or may be extremely difficult to remove. Thus, there is a need for a system to overcome the problems associated with a magnetic field penetrating the polishing or grinding surface and the problems associated with attaching polishing or grinding materials directly to a platen using PSA backing.

BRIEF SUMMARY OF THE INVENTION

This invention recognizes and provides a solution to the problems associated with using a magnetic attachment system for coupling grinding or polishing surfaces and materials to a platen. Briefly the present invention comprises a system for grinding or polishing materials in which the grinding or polishing surface material is affixed to a platen using a magnetic field in a manner which precludes the field from acting upon the grinding or polishing swarf. The invention thus comprises a combination of elements including a movable platen utilized to move the grinding or polishing element to prepare the specimen surface. The movable platen has a top side that magnetically attaches to a barrier element. The barrier element inhibits the magnetic field from crossing or passing through the barrier element and interfering with the grinding or polishing process. The barrier element has two sides or layers, a first side or layer and a second side or layer. The first side is magnetically attached to the top side of the movable platen. The second side is impervious or nearly impervious to a magnetic field and is attached to a grinding or polishing element, for example, by a PSA material. The grinding or polishing element has a preparation side, to prepare specimens, and a platen attachment side that is attached to the second side of the barrier element.

The barrier element shields the grinding or polishing surface from the magnetic field and thus the resulting grinding or polishing surface of this system is not susceptible to the magnetic field caused by the magnetized material. Because the system prevents residual magnetism from interfering with the preparation of materials, problems with swarf adhering to the grinding or polishing surface are eliminated. Furthermore, because only the grinding paper or polishing cloth is disposed of when the grinding or polishing surface wears out, cost is reduced and waste disposal is improved because the barrier and the platen in this magnetic system are reused.

Accordingly, an object of the present invention is to provide a grinding or polishing surface that has a reduced magnitude of magnetic field. Thus, this invention reduces the magnetic field to which the preparation side of the grinding or polishing element is exposed.

Another object of this invention is to provide a system that is easier to maintain. One prior art system includes a magnetic fabric permanently attached to the platen. When the magnetic material becomes worn, the entire platen must be replaced. This invention provides for a magnetic material that is not permanently bonded to the platen. This allows removal of the magnetic material and replacement of the magnetic material rather than the entire platen.

A further object of this invention is to provide an economical specimen grinding or polishing system. The system allows reduced time to change the grinding or polishing element on the platen. Changing the grinding or polishing surface entails merely breaking the magnetic bond between the barrier element and the platen and placing a different barrier element with a different grinding or polishing surface on the platen.

Yet another object of this invention is to provide a system that is better for the environment from a waste disposal perspective. This invention allows easier recycling of products during waste disposal. Because the polishing surface is removable from the metal barrier, the cloth can be separately disposed by recycling.

An additional object of this invention is to provide for ease of removing the barrier element. Providing a space, sized for a tool such as a screw driver, between the barrier element and the platen allows one to wedge a tool between the platen and the barrier element to break the magnetic field for easy removal of the barrier element.

The full range of objects, advantages, and features of the invention are only appreciated by a full reading of this specification and a full understanding of the invention. Therefore, to complete this specification, a detailed description of the invention and the preferred embodiments follow, after a brief description of the drawing wherein additional objects, advantages and features of the invention are disclosed.

BRIEF DESCRIPTION OF THE DRAWINGS

A preferred embodiment of the invention will be described in relation to the accompanying drawings comprised of the following figures.

DETAILED DESCRIPTION OF THE INVENTION

Figure 1:
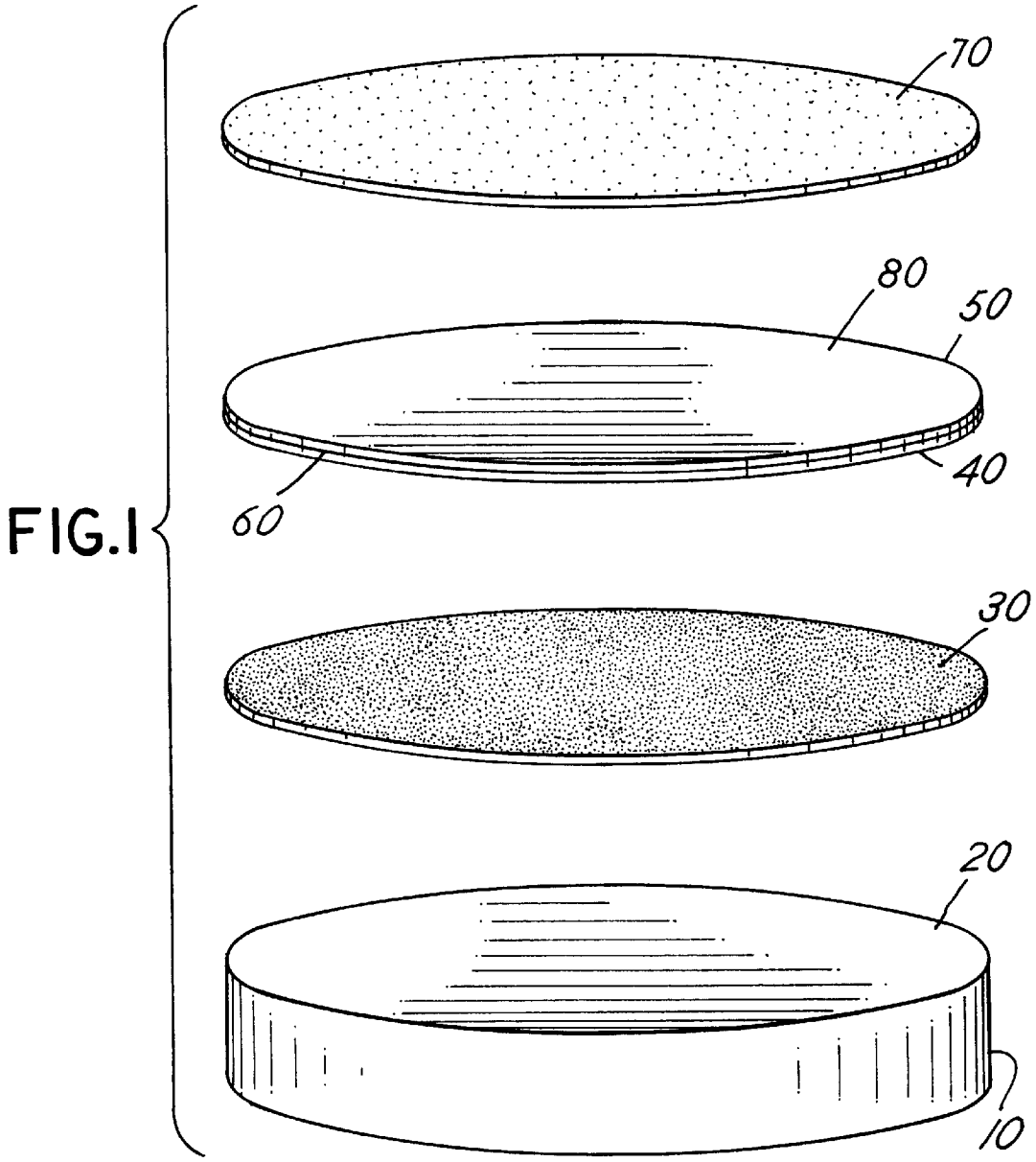
FIG. 1 is an exploded, isometric view of a first preferred embodiment of the magnetic preparation disc system of the present invention having a magnetic interface and magnetic barrier positioned between a grinding or polishing surface and a platen.

Referring to FIG. 1, a magnetic element 30 is attached to a movable platen 10 on a top side 20 thereof. The magnetic element 30 can be attached to such a movable platen 10 by means of a pressure sensitive adhesive 15. The periphery of the magnetic element 30 may be congruent with the periphery of the movable platen 10.

A separate barrier element 80, includes a non-magnetically responsive portion 50 and a magnetically responsive portion 40 that is attracted to the magnetic element 30. Thus portion 40 of barrier element 80 is placed against the magnetic element 30. Magnetically responsive portion 40 is interposed between non-magnetically responsive portion 50 and magnetically responsive portion 40. Barrier element 80 can be composed of bimetallic discs made from 18-gauge stainless steel. The magnetic portion 40 can be ferromagnetic (type 430) ferritic stainless steel which is attracted to the magnetic element 30 attached to the movable platen 10. The non-magnetic portion 50 of the barrier element 80 can be non-magnetic (type 304 or 316) austenitic stainless steel which is not magnetically attracted and which shields or prevents a magnetic field from completely penetrating the barrier element 80. The non-magnetic portion 50 and the magnetic portion 40 are bonded together preferably with a bonding material 60 such as an unsupported acrylic pressure sensitive transfer film like Unifilm U261 that is not degraded by alcohol, water or acetone. A grinding or polishing preparation element 70 is attached to the non-magnetic portion 50 using a pressure sensitive adhesive.

Figure 2:
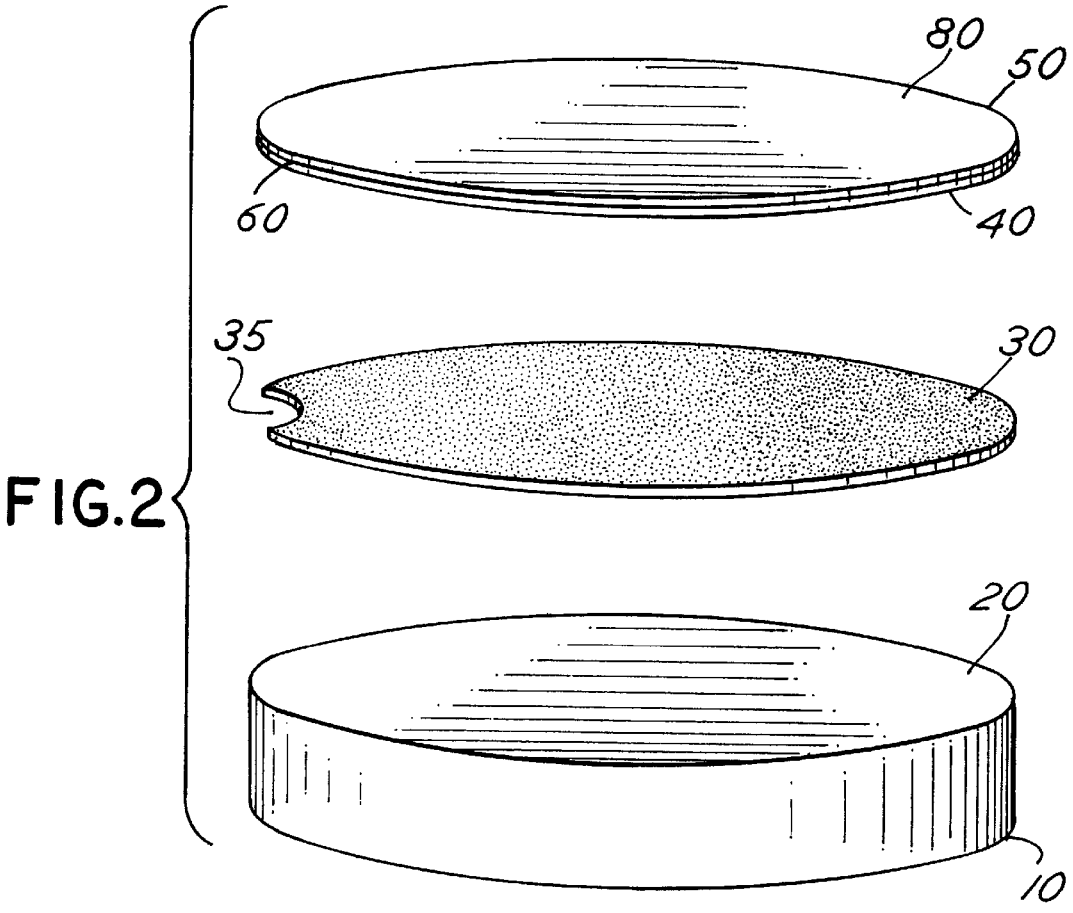
FIG. 2 is an isometric view of a platen, magnetic element and barrier element depicting the slot in the magnetic element to facilitate removal of the element.

Referring to FIG. 2, the movable platen 10 can extend beyond the periphery of the magnetic element 30. A notch 35 can be put into the magnetic element 30 to facilitate removal of the barrier element 80. An object, such as a screwdriver, can then easily be wedged between the movable platen 10 and the barrier element 80 at the notch 35 to facilitate removal. Alternatively, it is also possible to remove a notch 35 of material from the magnetic portion 40 of the barrier element 80 to thereby create a notch 35 which will facilitate removal.

The described platen system for grinding or polishing specimens utilizes a means for magnetically attaching the grinding or polishing preparation element 70 to the movable platen 10 and a means for attenuating or shielding the element 70 from the magnetic field, created by the magnetic attachment means, interposed between the means for magnetically attaching the grinding or polishing preparation element 70 to the movable platen 10 and the grinding or polishing preparation element 70. In addition to the methods known to those skilled in the art, the means for magnetically attaching the grinding or polishing preparation element 70 consists of a magnetic element 30 attached to the movable platen 10 and a barrier element 80 having two sides, layers, or portions 40, 50, with the first side 40 magnetically attached to the magnetic element 30. The grinding or polishing preparation element 70 is then bonded to the second side 50 of the barrier element 80 with an adhesive. The means for attenuating the magnetic field, in addition to the methods known to those skilled in the art, include a barrier element 80 composed of two layers 40, 50. One layer 40 is magnetically responsive and magnetically attaches to the magnetic element 30. The other layer 50 is non-magnetically responsive and screens the magnetic field from the grinding or polishing preparation element 70. Various means for magnetically attaching the grinding or polishing preparation element and the means for attenuating the magnetic field in addition to the means described herein may be utilized.

Many non-magnetic metal, alloy, ceramic, etc. materials may be used for the non-magnetic portion 50 of the barrier element 80. An austenitic stainless steel is a preferred choice due to its relative low cost, availability in sheet form (with a polished surface), and corrosion resistance (types 304 and 316 are the most widely available). Likewise, the magnetic portion 40 of the barrier element 80, may include various ferromagnetic materials such as, Fe, Ni, or Co metal and alloys, and a few nonferrous alloys. However, a ferritic stainless steel (of which type 430 is the most commonly made in sheet form) is a preferred choice due to cost, availability and corrosion resistance. The thickness of the respective portions 40, 50 (430 and 304 or 316) must preferably be sufficient to provide rigidity (so that they are not bent when the grinding or polishing preparation element 70 or other surface is removed) and to shield the working surface from the magnetic field of the underlying magnetic element 30.

Figure 5:
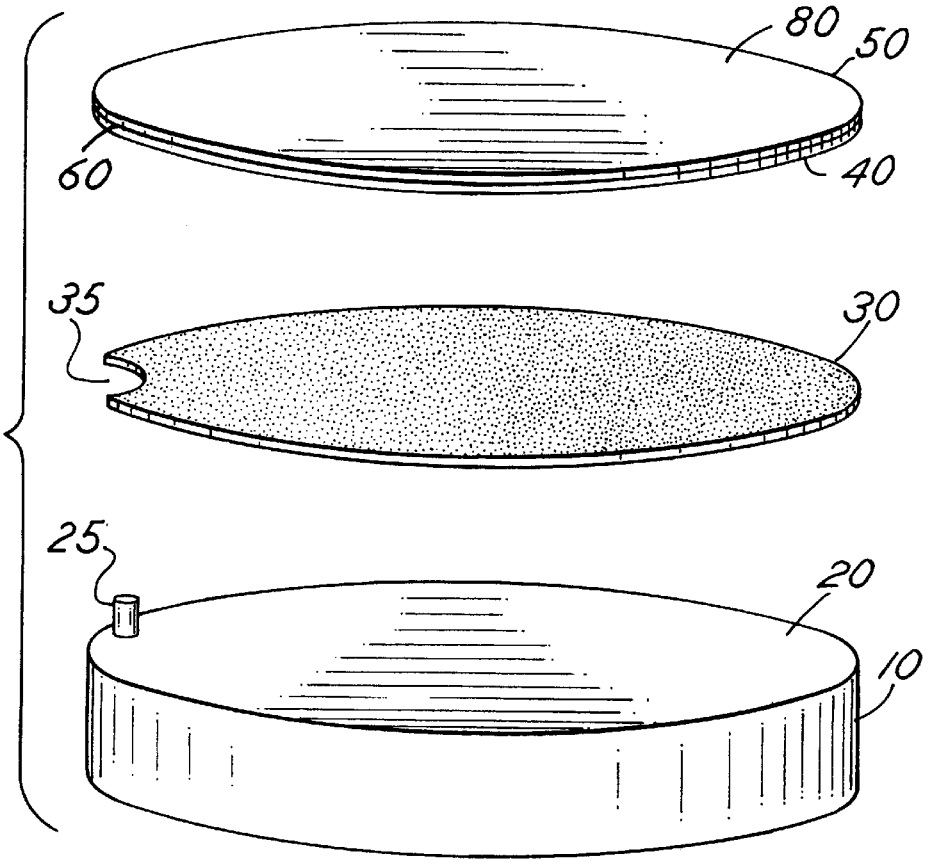
FIG. 5 is an isometric view of an alternate embodiment.

The strength of the magnetic field of the magnetic element 30 should preferably prevent the barrier element 80 from rotating due to the force of a test sample against a grinding or polishing preparation element 70. As depicted in FIG. 5, an alternative method of preventing the rotation of the barrier element 80 and the grinding or polishing preparation element 70 during use is to utilize the magnetic force of the magnetic element 30 in combination with an antirotation device. The antirotation device can consist of one or more pins 25 that extend between the barrier element 80 and the movable platen 10.

The optimal thickness required to shield the working surface can be determined empirically. The thickness is influenced by the magnetic strength (permeability) of the magnetic element 30, by the thickness of the magnetic portion 40 and by the thickness of the non-magnetic portion 50. The preferred embodiment includes a 0.060 inch thick magnetic element 30 with a magnetic field of 120 pounds per foot squared where the non-magnetic portion 50 is 0.025 to 0.045 inches thick and the magnetic portion 40 is 0.020 to 0.045 inches thick.

Figure 3:
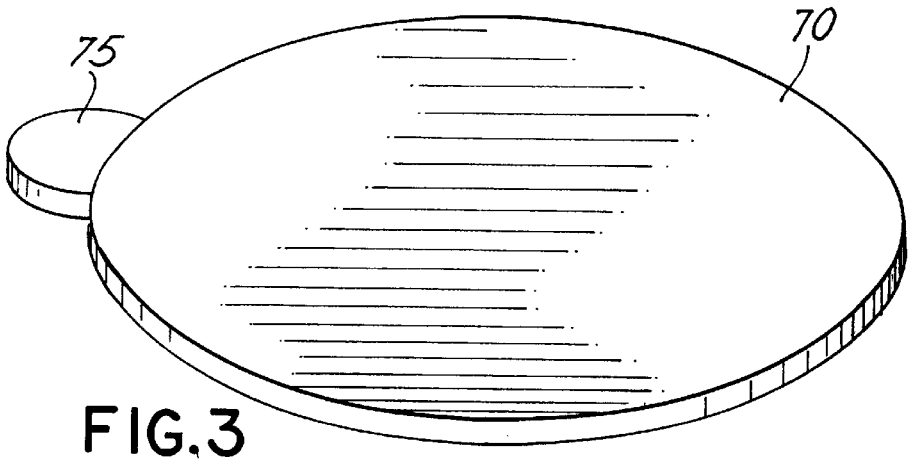
FIG. 3 is an isometric view of the polishing element including a removal tab.

The grinding or polishing preparation element 70 can be attached to the barrier element 80 using a pressure sensitive adhesive 65 such as a hot melt thermal plastic such as Henkel Adhesives #6476. The adhesive used should be strong enough to prevent the grinding or polishing element 70 from moving but still allow relatively easy removal. Referring to FIG. 3, to aid removal of the grinding or polishing preparation element 70 from the non-magnetic portion 50, an extra portion of paper or cloth, that can be in the shape of a semi-circular or thumb-nail shaped tab 75, extends beyond the normal outer diameter of the grinding or polishing preparation element 70. The tab 75 sticks out beyond the outer edge of the barrier element 80. After the grinding or polishing preparation element 70 is worn, the tab 75 is grasped and pulled to remove the abrasive surface from the barrier element 80.

Figure 4:
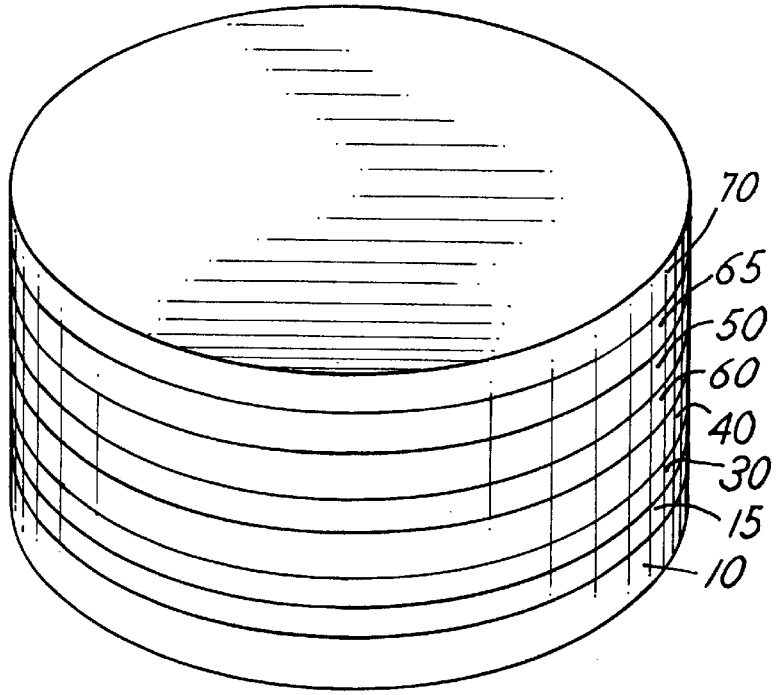
FIG. 4 is a schematic view of the layers of the construction of a preferred embodiment.

As depicted in FIG. 4, the preferred embodiment is comprised of a series of layers. The first layer is the movable platen 10. The next layer is an adhesive 15 such as an adhesive tape with the side adjacent to the magnetic material 20 being an acrylic adhesive while the side adjacent to the platen 10 is a rubber-based adhesive. The magnetic element 30 is attached to the platen 10 using the adhesive 15. The magnetically attracted portion 40 is magnetically attached to the magnetic element 30. A bonding material 60, such as an unsupported acrylic pressure sensitive transfer film like Unifilm U261, attaches the magnetic portion 40 to the non-magnetic portion 50. A pressure sensitive adhesive 65 is applied to the grinding or polishing preparation element 70 and this element is affixed to the non-magnetic portion 50.

Some alternative structures include, but are not limited to, the following variations. The magnetic portion 40 and the non-magnetic portion 50 of the barrier element 80 can be mechanically connected. The magnetic portion 50 and the non-magnetic portion 40 may, for example, be riveted together using counter bored holes to ensure flat surfaces. Also, the barrier element 80 may be composed of various unspecified materials that have similar characteristics to those defined. In addition, the thickness of the barrier element 80 may vary depending on the type of material and the strength of the magnetic element 30. The various dimensions of thickness of materials to maintain both connection between the movable platen 10 and the barrier element 80 and to block or reduce the magnetic field are considered equivalent to this invention.

Therefore, the description of the apparatus of this invention is not intended to be limiting but is merely illustrative of the preferred embodiment of this invention. Other apparatus which incorporate modifications or changes to that which has been described herein are equally included within the scope of the following claims and equivalents thereof.

I claim:

1. An apparatus for metallographic preparation of the surface of a specimen producing swarf when polished, the swarf being attracted by a magnetic field caused by the apparatus, comprising, in combination:

a movable platen having a top side;

a barrier element capable of blocking or reducing a magnetic field, said barrier element having a first side and a second side, said barrier element first side magnetically attached to the top side of the movable platen; and a grinding or polishing preparation element having a preparation side and a platen attachment side, said platen attachment side attached to the second side of the barrier element, said barrier element shielding the preparation element from the magnetic field.

2. The apparatus of claim 1, including a magnetic element affixed to the top side of the movable platen magnetically coupled to the first side of the barrier element.

3. The apparatus of claim 2, wherein the magnetic element generates a magnetic field at least strong enough to prevent rotation of the barrier element relative to the movable platen during use.

4. The apparatus of claim 2, wherein the magnetic element has an edge that is not congruent with the movable platen.

5. The apparatus of claim 2, wherein the magnetic element is generally congruent with the movable platen.

6. The apparatus of claim 1 wherein the barrier element comprises:

a non-magnetic portion; and a magnetic portion connected to the non-magnetic portion, said magnetic portion juxtaposed in opposition to the top side of the platen and intermediate the platen and the non-magnetic portion.

7. The apparatus of claim 6, wherein the barrier element does not allow the magnetic field to pass completely through the non-magnetic portion.

8. The apparatus of claim 6, wherein the non-magnetic portion is austenitic stainless steel.

9. The apparatus of claim 6, wherein the magnetic portion is ferritic stainless steel.

10. The apparatus of claim 6, wherein the non-magnetic portion and the magnetic portion are bonded to form a unitary element.

11. The apparatus of claim 10, wherein the bond between the non-magnetic portion and the magnetic portion is at least partly insoluble to solutions used to remove adhesives.

12. The apparatus of claim 1 including a magnetic element affixed to the top side of the movable platen and magnetically attached by a magnetic field to the first side of the barrier element, said barrier element including a non-magnetic portion and a magnetic portion affixed to the non-magnetic portion.

13. The apparatus of claim 12, wherein the magnetic portion is ferritic stainless steel.

14. The apparatus of claim 12, having the non-magnetic portion having a first side and a second side and the magnetic portion having a first side and a second side wherein the first side of the non-magnetic portion is bonded to the second side of the magnetic portion.

15. The apparatus of claim 14, wherein the bond between the non-magnetic portion and the magnetic portion is at least partly insoluble to solutions used to remove adhesives.

16. The apparatus of claim 12, wherein the non-magnetic portion is austenitic stainless steel.

17. The apparatus of claim 12, wherein the barrier element non-magnetic portion screens the magnetic field from the magnetic portion.

18. The apparatus of claim 1, wherein the grinding or polishing preparation element has a first side and a second side and an edge and being generally circular along the edge, the first side up to the generally circular edge is covered with an adhesive and the generally circular edge has a section extending out beyond the generally circular edge and the adhesive.

19. An apparatus for metallographic preparation of the surface of a specimen producing swarf when polished, the swarf being attracted by a magnetic field caused by the apparatus, comprising, in combination:

a generally circular, movable platen having a top side;

a magnetic element having a first side and a second side, the magnetic element first side being affixed to the top side of the movable platen with an adhesive;

a barrier element comprising a disc of material capable of reducing a magnetic field, having a magnetic field attenuating layer and a magnetically responsive layer, said barrier element magnetically responsive layer being magnetically attached to the second side of the magnetic element; and a generally circular grinding or polishing preparation element in the form of a disc having a grinding or polishing side, an opposite side and an edge, said opposite side attached to the barrier element impermeable layer, said barrier element shielding the preparation element from the magnetic field.

20. The apparatus of claim 19, wherein the magnetic element is generally congruent with the movable platen.

21. The apparatus of claim 19, wherein the magnetic element has an edge that is not congruent with the movable platen.

22. The apparatus of claim 19, wherein the magnetic element generates a magnetic field at least strong enough to prevent rotation of the barrier element relative to the movable platen during use.

23. The apparatus of claim 19, wherein the barrier element layer is austenitic stainless steel.

24. The apparatus of claim 19, wherein the barrier element magnetically responsive layer is ferritic stainless steel.

25. The apparatus of claim 19, having the barrier element magnetically responsive layer having a first side and a second side and the impermeable layer having a first side and a second side wherein the first side of the barrier element layer is bonded to the second side of the barrier element magnetically responsive layer portion.

26. The apparatus of claim 25, wherein the bond between the barrier element non-magnetically responsive layer and the barrier element magnetically responsive layer is at least partly insoluble to solutions used to remove adhesives.

27. The apparatus of claim 19, wherein the barrier element does not allow the magnetic field to pass completely through the impermeable layer.

28. The apparatus of claim 19, wherein the barrier element impermeable layer attenuates the magnetic field from the magnetically responsive layer.

29. The apparatus of claim 19, wherein the grinding or polishing preparation element has a first side and a second side and an edge and being generally circular along the edge, the first side up to the generally circular edge is covered with an adhesive and the generally circular edge has a section extending out beyond the generally circular edge and the adhesive.

30. An apparatus for metallographic preparation of the surface of a specimen producing swarf when polished, the swarf being attracted by a magnetic field caused by the apparatus, comprising, in combination:

a movable platen having a top side;

a grinding or polishing preparation element having a preparation side and a platen attachment side;

a means for magnetically attaching the grinding or polishing preparation element to the movable platen; and a means for attenuating a magnetic field interposed between the means for magnetically attaching the grinding or polishing preparation element to the movable platen and the grinding or polishing preparation element, wherein said means for attenuating the magnetic field shields the preparation element from the magnetic field.

31. An apparatus for preparation of a surface producing swarf when polished, the swarf being attracted by a magnetic field caused by the apparatus, comprising, in combination:

a movable platen having a top side;

a barrier element capable of reducing a magnetic field, said barrier element having a first side and a second side, said barrier element first side magnetically attached to the top side of the movable platen; and a preparation element having a preparation side and a platen attachment side, said platen attachment side attached to the second side of the barrier element, said barrier element shielding the preparation element from the magnetic field.

* * * * *